US005170356A

United States Patent [19]

Horita et al.

[11] Patent Number: 5,170,356

[45] Date of Patent: Dec. 8, 1992

[54] METHOD OF APPARATUS FOR METERING AN ELONGATE STRINGER CHAIN

[75] Inventors: Yoshiyuki Horita; Yasuhiko Matsuda, both of Toyama, Japan

[73] Assignee: Yoshida Kogyo K. K., Tokyo, Japan

[21] Appl. No.: 568,079

[22] Filed: Aug. 16, 1990

[30] Foreign Application Priority Data

Aug. 17, 1989 [JP] Japan ..... 1-211755

[51] Int. Cl.[5] ..... G06F 15/46; B21D 53/50

[52] U.S. Cl. ..... 364/468; 29/408; 29/766; 364/562

[58] Field of Search ..... 364/468, 550, 551.01, 364/551.02, 560-562; 29/408, 409, 410, 766-770, 33.2; 24/381; 377/1-3, 16-18, 19, 24

[56] References Cited

U.S. PATENT DOCUMENTS 3,050,226 8/1962 Perrella ..... 226/157
3,987,533 10/1976 Sandgren ..... 29/410
4,187,750 2/1980 Ito et al. ..... 83/257 X
4,310,961 1/1982 Clearwater ..... 29/408
4,561,161 12/1985 Morita ..... 29/408
4,625,375 12/1986 Osaki ..... 29/408 X

FOREIGN PATENT DOCUMENTS 62-84705 4/1987 Japan .

*Primary Examiner*—Joseph Ruggiero
*Attorney, Agent, or Firm*—Hill, Van Santen, Steadman & Simpson

[57] ABSTRACT

A method of and an apparatus for metering an elongate stringer chain to be finished into slide fasteners of different lengths, the metering being based on an element pitch P derived from dividing a given metering length L by the number of coupling elements thereon. The stringer chain is held substantially in tensionless suspension while it is being metered to achieve a maximum of metering accuracy.

16 Claims, 4 Drawing Sheets

METHOD OF APPARATUS FOR METERING AN ELONGATE STRINGER CHAIN

BACKGROUND OF THE INVENTION

1. Field of the Invention

This invention relates generally to the manufacture of slide fasteners from an elongate stringer chain and more particularly to a method of and an apparatus for metering the length of such a stringer chain to be fed and finished into individual slide fastener products.

2. Prior Art

Means have been proposed to mechanically meter an elongate continuous stringer chain to give selected individual lot lengths which are to be finished into slide fastener products. Such known metering means essentially comprises an encoder operatively associated with a feed roller unit in the path of feed of the stringer chain, the output of the encoder being computed to control the length of the stringer chain. This prior art has a drawback in that it is difficult to make accurate metering of the stringer chain in motion due to slippage between the feed rollers and the stringer chain and further due to elongation of the stringer chain while in transit.

Japanese Laid-Open No. 62-84705 discloses an improved means of advancing and stopping a stringer chain at a predetermined position, which means relies on counting the number of coupling elements on the stringer chain. Such positioning means however fails to account for discrepancies in an element-to-element pitch or spacing between adjacent coupling elements which may arise out of the switching between different manufacturing apparatus or between different stringer chain lots and further out of elongation of the stringer chain during feed movement, and therefore poses a problem in accurate and uniform metering function.

SUMMARY OF THE INVENTION

It is therefore a primary object of the invention to provide a method and apparatus for metering an elongate stringer chain for slide fasteners which will eliminate the foregoing difficulties of the prior art and which will more specifically enable the metering of a stringer chain with utmost accuracy and efficiency even in the event there are discrepancies or errors in the pitch of adjacent coupling elements on the stringer chain.

A more specific object of the invention is to provide a method and apparatus which is capable of metering a stringer chain to a predetermined working length with utmost accuracy on the basis of an element pitch computed from the number of coupling elements on a unit metering length, whereby the necessity of providing extra provisional lengths of the stringer chain in consideration of discrepancies in the element pitch from one lot to another is precluded, so that the risk of wastes of the stringer chain material is eliminated.

Another object of the invention is to provide a method and apparatus which is capable of accurate metering of a stringer chain by holding the stringer chain substantially tensionless while being metered The above and other objects and advantages of the invention will be better understood from the following detailed description taken in conjunction with the accompanying drawings.

According to one aspect of the invention, there is provided a method of metering an elongate stringer chain for slide fastener comprising forming a U-shaped loop of the stringer chain and feeding and metering the stringer chain while it is held in substantially tensionless suspension.

According to another aspect of the invention, there is provided a method of metering an elongate stringer chain having rows of coupling elements which comprises: counting the number of coupling elements Ea attached to a given metering length L of the stringer chain; dividing the metering length by the counted number of coupling elements to derive an element pitch P, thus $$\frac{L}{Ea} = P$$

and dividing a predetermined working length L' of stringer chain by the element pitch P to derive a prospective number of coupling elements $E_b$ corresponding to the working length L', thus $$\frac{L'}{P} = Eb$$

An apparatus carrying the method of the invention into practice comprises: (a) a feed-in unit including a pressure roller and a pressure roller for feeding the stringer chain; (b) a guide unit including an upper pulley and a lower pulley disposed in vertically spaced relation; (c) a metering unit for metering the stringer chain by counting the number of coupling elements thereon; (d) a drive means and adapted to provide a relative movement between the guide unit and the meter unit for a distance defining a metering length L of the stringer chain; (e) a feed-out unit including a feed roller and a pressure roller and disposed downstream of the guide unit for delivering the stringer chain; and (f) a computer control unit comprising a logical operation circuit operatively connected to the metering unit and the drive means for computing an element pitch P and a control circuit operatively connected to the metering unit and the logical operation circuit for determining a working length L' of the stringer chain.

The term "element pitch" as used herein represents an interspace between adjacent coupling elements on a given stringer chain to be finished into a product slide fastener.

By the term "working length" is meant a total length of a given lot of stringer chain which may be for example 120 meters encompassing a prospective product number of 500 slide fasteners each measuring 24 centimeters long.

DETAILED DESCRIPTION OF THE INVENTION

Figure 1:
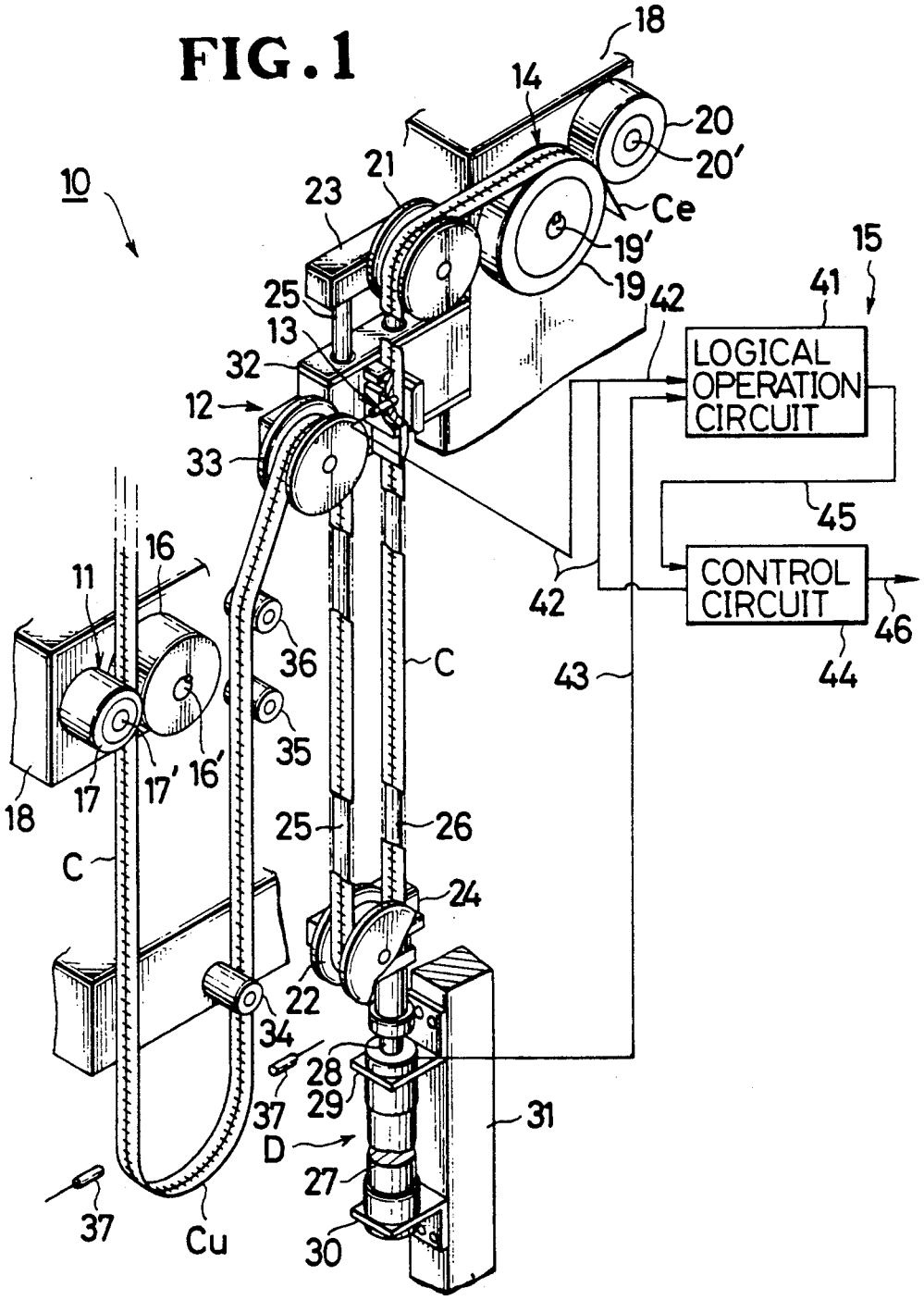
FIG. 1 is a perspective elevational view of an apparatus for metering a stringer chain according to the invention.

Referring now to the drawings and FIG. 1 in particular, there is shown an apparatus 10 which carries the method of the invention into practice and which broadly comprises a feed-in unit 11, a guide unit 12, a metering unit 13, a feed-out unit 14 and a computer control unit 15.

The feed-in unit 11 comprises a feed roller 16 and a pressure roller 17 rotatably mounted on respective horizontally extending shafts 16' and 17' journalled in a support frame 18. The pressure roller 17 is brought into and out of nipping engagement with the feed roller 16 by a suitable lever means not shown.

The feed-out unit 14 is located downstream of the guide unit 12 with respect to the flow of a stringer chain C and comprises a feed roller 19 and a pressure roller 20 for delivering the stringer chain C and rotatably mounted on respective horizontal shafts 19' and 20' journalled in the frame 18. The rollers 19 and 20 are brought into and out of nipping engagement in a manner similar to the unit 11.

The guide unit 12 is interposed between the feed-in unit 11 and the feed-out unit 14 and comprises an upper pulley 21 and a lower pulley 22 rotatably mounted on an upper support bridge 23 and a lower support bridge 24, respectively. The upper and lower bridges 23, 24 are interconnected by a pair of vertically extending guide rods 25, 26.

A drive means D is adapted to provide relative movement between the guide unit 12 and the metering unit 13 and includes a fluid operated cylinder 27 having a piston rod 28 and secured by bracket members 29, 30 to a lower support block 31. The lower bridge 24 is connected to the piston rod 28 which causes the bridges 23, 24 to ascend and descend together with the rods 25, 26 which move vertically through an upper support block 32 secured to the frame 18. A guide pulley 33 is rotatably mounted on the upper support block 32.

The feed rollers 16, 19, the upper and lower pulleys 21, 22 and the guide pulley 33 are all rotatable in a common vertical plane, having their respective peripheral centers disposed in alignment.

As shown in FIG. 1 the stringer chain C is passed downwardly between the feed roller 16 and the pressure roller 17 in the feed-in unit 11, trained up around guide rollers 34, 35, 36, then around the guide pulley 33, downwardly toward and up around the lower pulley 22, upwardly toward and around the upper pulley 21 until the stringer chain C is nipped between the feed roller 19 and the pressure roller 20 in the feed-out unit 14.

According to one or first embodiment of the invention, a first span of the stringer chain C between the guide pulley 33 and the lower pulley 22 and a second span of the stringer chain C between the lower pulley 22 and the metering unit 13 add up to define a metering length L of the stringer chain which can be metered at a maximum. Importantly, the metering length L of the stringer chain is held substantially in tensionless suspension except for a tension applied by the weight of the first and second spans of the stringer chain C and a tension applied by frictional engagement of the stringer chain C with the guide rollers and the pulleys disposed upstream of the metering unit 13. This tensionless suspension of the stringer chain C is maintained by establishing a U-shaped loop Cu of the stringer chain C between the feed-in unit 11 and the guide pulley 33.

To ensure that the U-shaped loop Cu of the stringer chain C be maintained during operation of the apparatus 10, there are provided a pair of photoelectric sensors 37, 37 located on opposite ends of the U-shaped loop Cu for monitoring the presence of this loop and having their respective output signals connected to a drive (not shown) for the feed-in unit 11 so that when the U-shaped loop Cu has moved upwardly beyond the sensors 37, 37; that is, when the rate of feed of the stringer chain C by the feed-out unit 14 becomes greater than that by the feed-in unit 11 for some reason, the speed of the feed roller 16 in the feed-in unit 11 is increased thereby resuming and maintaining the U-shaped loop Cu in the proper position.

Figure 2:
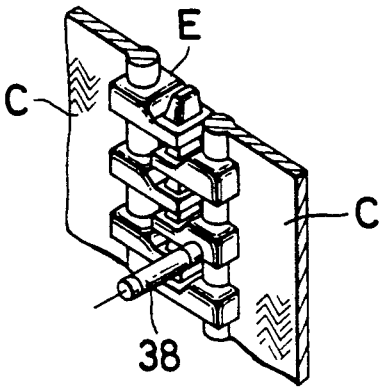
FIG. 2 is a segmentary perspective view on enlarged scale of a stringer chain having rows of metallic coupling elements.
Figure 3:
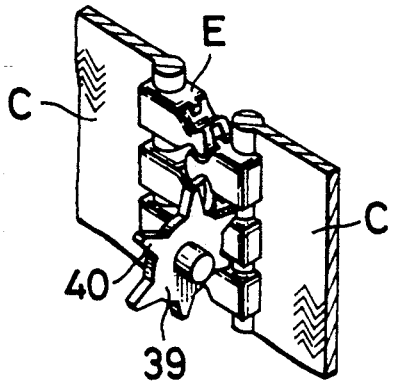
FIG. 3 is a view similar to FIG. 2 but showing a stringer chain having rows of plastics coupling elements.

The metering unit 13 is provided at the upper support block 32 adjacent to the guide pulley 33 for metering the stringer chain C by counting the number of coupling elements E on a given length thereof. The unit 13 comprises a sensor 38 for detecting the coupling elements E which are made of a metallic material as shown in FIG. 2, or a toothed rotor 39 connected to an encoder (not shown) and having a plurality of equally spaced teeth 40 engageable between adjacent coupling elements E which are made of a plastics material as shown in FIG. 3.

Figure 4:
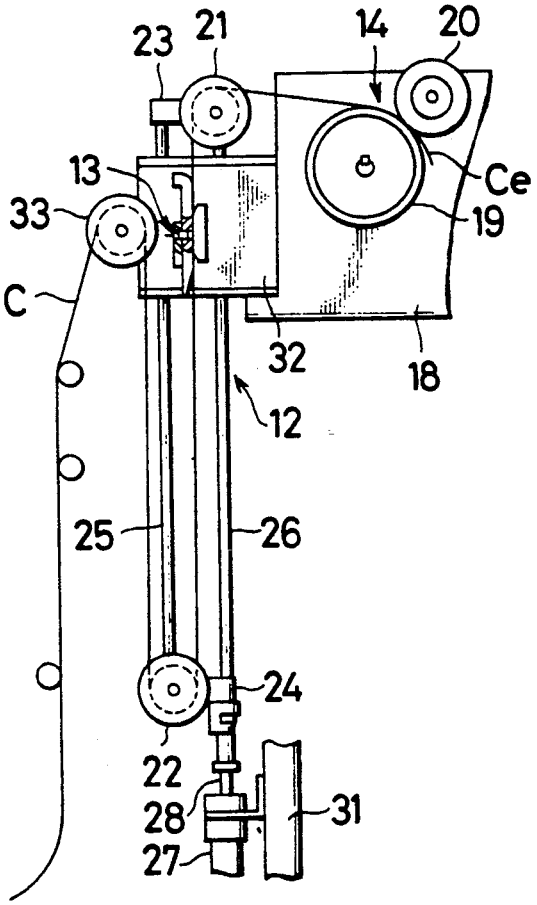
FIG. 4 is a diagrammatic side elevational view of part of the apparatus of FIG. 1 shown in one operative position.
Figure 5:
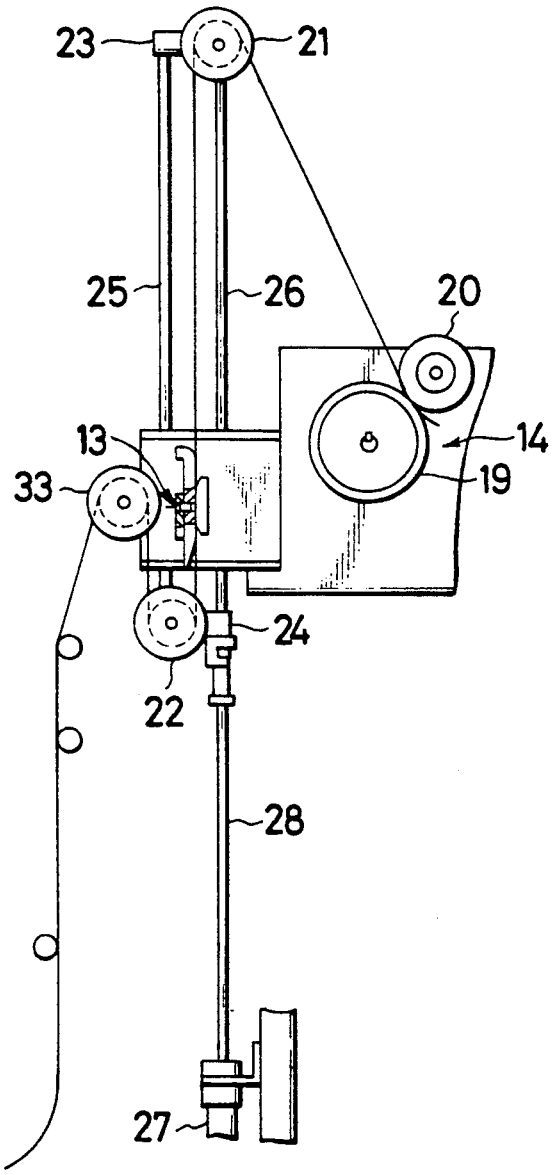
FIG. 5 is a view similar to FIG. 4 but showing the apparatus in another operative position.

The computer control unit 15 comprises a logical operation circuit 41 operatively connected through an output circuit 42 to the metering unit 13 and through an output circuit 43 to the piston rod 28 of the cylinder 27, and a control circuit 44 operatively connected to the output circuit 42 and through an output circuit 45 to the logical operation circuit 41. The logical operation or arithmetic circuit 41 receives from the output circuit 42 of the metering unit 13 a signal representing the number of the coupling elements Ea which have been counted and from the output circuit 43 of the piston rod 28 a signal representing a metering length L of the stringer chain, which length L is an equivalent of a stroke length of the piston rod 28 measuring for instance from the stroke end positioned as shown in FIG. 4 to the approach end positioned as shown in FIG. 5. The logical operation circuit 41 computes an element pitch P from the two signals and transmits the computed signal to the control circuit 44 which stores a signal representing a prospective working length L' of the stringer chain C to be fed to and processed at a subsequent finishing station and which receives the output signal from the metering unit 13 through the output circuit 42.

The control circuit 44 functions to compare the signal representative of the element pitch P from the logical operation circuit 41 against the signal representative of a prospective number of coupling elements Eb corresponding to the working length L' stored in the control circuit 44 and thus decides and detects a condition that the stringer chain C has been metered over the metering length L or over the working length L'. An output 46 from the control circuit 44 is utilized as a control signal at least to discontinue the operation of the metering unit 13, or to stop the operation of the whole apparatus 10, or alternatively to cut the stringer chain C immediately upstream of the metering unit 13.

Preparatory to the operation the apparatus 10 with the piston rod 28 retracted to the stroke end position shown in FIG. 4, the stringer chain C is introduced through the feed-in unit 11 and the guide unit 12 and past the metering unit 13 over the feed-out unit 14 until its leading end Ce is nipped between the feed roller 19 and the pressure roller 20. In this instance, it is important to establish or form the U-shaped loop Cu adjacent the sensors 37, 37 as already described. Then, the cylinder 27 is actuated to make an approach end stroke of the piston rod 28 to the position of FIG. 5 thereby taking the stringer chain C up past the metering unit 13 for a distance corresponding to a metering length L which is an equivalent of the sum of the first span (between the guide pulley 33 and the lower pulley 22) and the second span (between the lower pulley 22 and the metering unit 13), or much longer than a full stroke of the piston rod 28 and which is therefore sufficient to hold metering errors to an absolute minimum.

An excess length of the stringer chain C extending between the leading end Ce thereof and the metering unit 13 can be held generally constant and hence stricken out from the predetermined metering length L without affecting the computation of the element pitch P.

Upon completion of a cycle of metering operation, the piston rod 28 is retracted to the position of FIG. 4, followed by the operation of the feed-in unit 11 and the feed-out unit 14 to advance the stringer chain C while the number of coupling elements E thereon is counted by the metering unit 13 and the output therefrom is incessantly transmitted to the control circuit 44 which determines the completion of feed of the working length L' of the stringer chain C in a manner already described.

When metering the same type and size of a stringer chain C as previously used for a different lot or a different working length L', it is not necessary to repeat the cycle of metering operation, but the previously computed element pitch P can be used per se.

Figure 6:
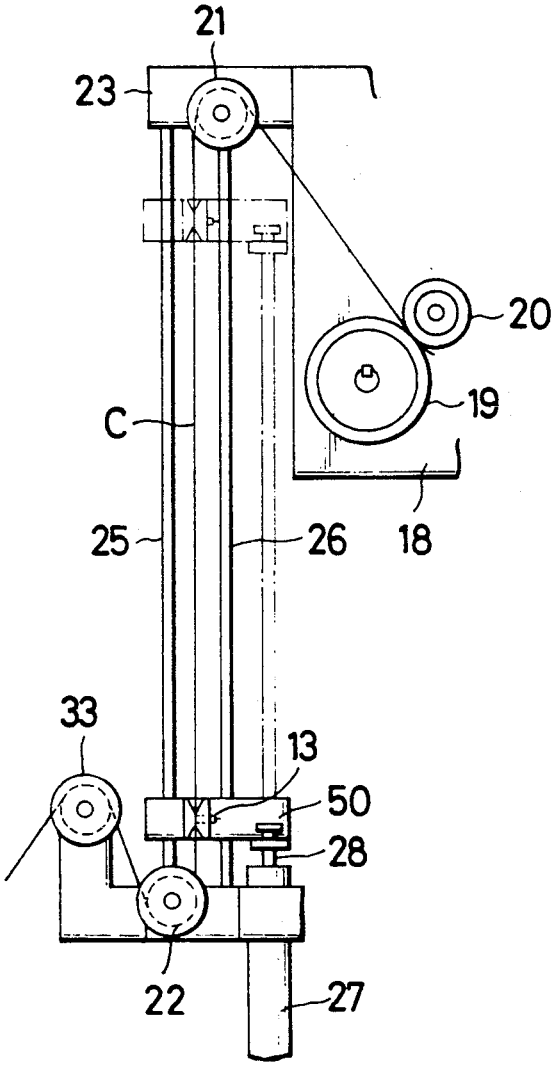
FIG. 6 is a diagrammatic side elevational view of a modified form of apparatus embodying the invention.

A modified form of metering apparatus 10 is shown in FIG. 6, in which the metering unit 13 is fixedly mounted on a bracket 50 secured to and movable with the piston rod 28 through or along the guide rods 25, 26 and the guide pulley 33 is rotatably mounted on the frame 18 adjacent to the cylinder 27.

According to this modified embodiment of the invention, the metering unit 13 is arranged to move relative to the stringer chain C spanning between the upper pulley 21 and the lower pulley 22, in contrast to the first embodiment previously described in which the stringer chain C is arranged to move relative to the metering unit 13 which is held stationary on the upper support block 32.

Obviously, various modifications and variations of the present invention are possible in the light of the above teaching. It is therefore to be understood that within the scope of the appended claims the invention may be practiced otherwise than as specifically described.

What is claimed is:

1. A method of metering an elongate stringer chain having a preselected length and having rows of coupling elements, which comprises:

passing a lead sample of said stringer chain having a predetermined length past a coupling element sensor;

sensing and counting the number of coupling elements attached to said lead sample of said stringer chain to determine a pitch between elements;

based on the pitch, calculating a total number of elements required for said preselected length of said elongate stringer chain;

passing said elongate stringer chain past said sensor;

sensing and counting coupling elements unit said total number of elements is reached.

2. A method according to claim 1 wherein the metering is effected over a vertical run of said stringer chain.

3. An apparatus for metering an elongate stringer chain having rows of coupling elements which comprises:

a feed-in unit including a feed roller and a pressure roller for feeding said stringer chain;

a guide unit including an upper pulley and a lower pulley disposed in spaced relation holding a portion of said stringer chain therebetween;

a metering unit for metering said stringer chain by counting the number of coupling elements thereon;

a drive means for causing a relative movement between said guide unit and said meter unit for a distance defining a metering length of said stringer chain;

a feed-out unit including a feed roller and a pressure roller and disposed downstream of said guide unit for delivering said stringer chain; and a computer control unit comprising a logical operation circuit signal connected to said metering unit and said drive means for computing an element pitch, and a control circuit signal connected to said metering unit and said logical operation circuit for determining a working length of said stringer chain.

4. An apparatus according to claim 3 further comprising means for forming a U-shaped loop of said stringer chain between said feed-in unit and said guide unit and means for monitoring the presence of said loop.

5. An apparatus according to claims 3 or 4 further including a guide pulley which forms with said lower pulley a first span of said stringer chain, while said lower pulley forms with said metering unit a second span of said stringer chain, said first and second spans together defining a maximum of said metering length.

6. An apparatus according to claim 3 wherein said upper and lower pulleys are movable vertically together relative to said metering unit.

7. An apparatus according to claim 3 wherein said metering unit is movable vertically relative to and between said upper and lower pulleys.

8. An apparatus according to claim 3 wherein the metering length L of said stringer chain is held vertically between said guide unit and said metering unit.

9. An apparatus for metering an elongate stringer chain having rows of coupling elements, comprising:

a feed-in unit including a first feed roller and a first pressure roller for feeding said stringer chain into said apparatus;

a guide unit including an upper pulley and a lower pulley disposed in spaced relation, said stringer chain threaded at least partially around said upper and lower pulleys;

a metering unit for sensing the presence of couplings passing thereby;

a means for translating a defined length of said stringer chain past said metering unit;

a feed-out unit including a second feed roller and a second pressure roller and disposed downstream of said guide unit for advancing said stringer chain; and a computer control means for receiving a signal from said metering unit corresponding to the number of couplings included in said defined length and calculating an element pitch having said defined length as an input and projecting a corresponding total number of couplings for an entire predetermined working length of said stringer chain, said computer control unit issuing a status control signal when said total number of couplings is reached.

10. An apparatus according to claim 9 further comprising a cutter and said status control signal is a signal connected to said cutter to sever said stringer chain after said total number of couplings is reached.

11. An apparatus according to claim 9, wherein said status control signal stops the operation of the apparatus.

12. An apparatus according to claim 9 further comprising means for forming a U-shaped loop of said stringer chain between said feed-in unit and said guide unit and means for monitoring the presence of said loop.

13. An apparatus according to claim 9 further including a guide pulley which forms with said lower pulley a first span of said stringer chain, while said lower pulley forms with said metering unit a second span of said stringer chain, said first and second spans together defining a maximum of said defined length.

14. An apparatus according to claim 9, wherein said upper and lower pulleys are movable vertically together relative to said metering unit.

15. An apparatus according to claim 9, wherein said metering unit is movable vertically relative to and between said upper and lower pulleys.

16. An apparatus according to claim 9, wherein the metering length L of said stringer chain is held vertically between said guide unit and said metering unit.

* * * * *